United States Patent [19]

Appel

[11] Patent Number: 4,570,267

[45] Date of Patent: Feb. 18, 1986

[54] UNISEX TORSO GARMENT WITH SLI VES

[75] Inventor: Bette J. Appel, Rochester, Mi .

[73] Assignee: Bette Appel, Inc., Bloomfield lls, Mich.

[21] Appl. No.: 644,846

[22] Filed: Aug. 27, 1984

[51] Int. Cl.[4] ..... A41L 3/00

[52] U.S. Cl. ..... 2/91

[58] Field of Search ..... 2/91, 69, 1 . 126

[56] References Cited

U.S. PATENT DOCUMENTS

| | | | |
|---|---|---|---|
| 1,157,341 | 10/1915 | Tallerday | 2/91 |
| 1,250,836 | 12/1917 | Fowler | 2/91 |
| 1,285,917 | 11/1918 | Bradley et al. | 2/91 |

*Primary Examiner*—Doris L. Troutman

*Attorney, Agent, or Firm*—Cullen, Sloman, Cantor, Grauer, Scott & Rutherford

[57] ABSTRACT

A unitary garment selectively covers the front upper torso of a female and the back upper torso of a male and comprises a front torso engaging panel. A pair of tapered sleeves have front portions which at their inner ends are of maximum height and extend from and merge with opposite sides of the panel as a continuation thereof. Rear portions of the sleeves are open at their inner ends and at their upper and lower boundaries merge respectively with the top and bottom edges of the panel.

6 Claims, 9 Drawing Figures

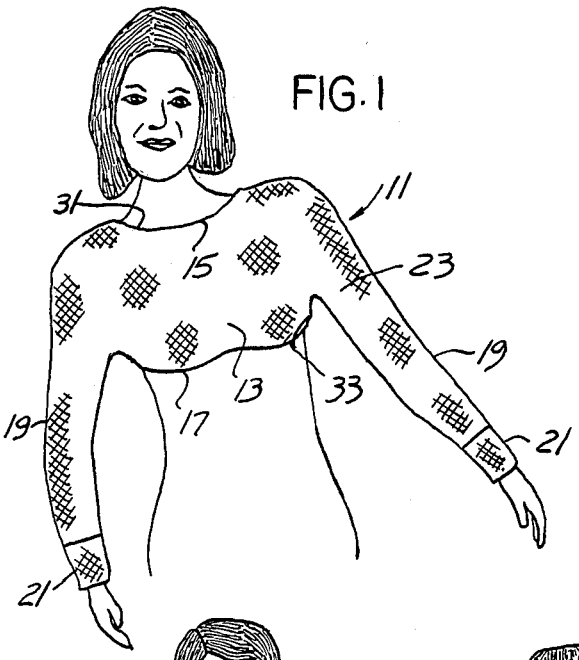
FIG. 1
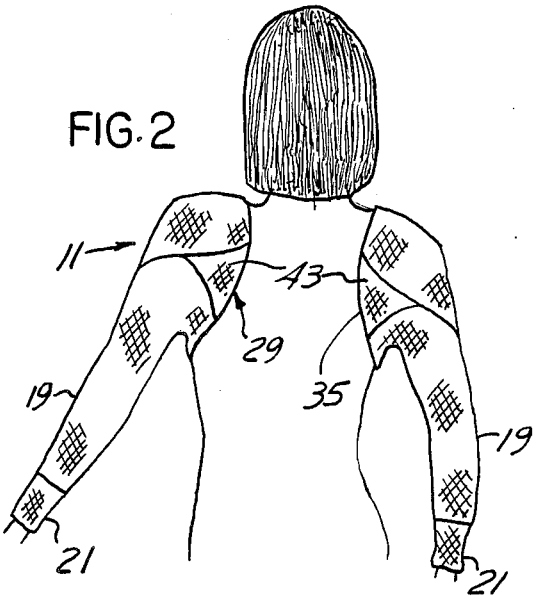
FIG. 2
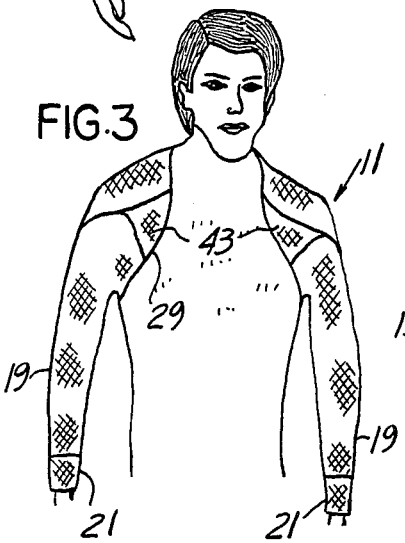
FIG. 3
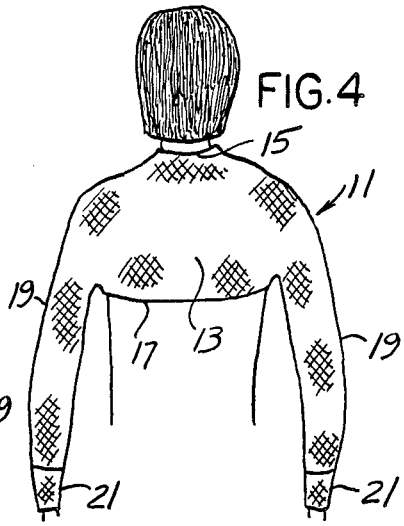
FIG. 4
FIG. 7
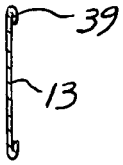
FIG. 9
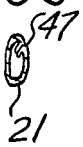
FIG. 8
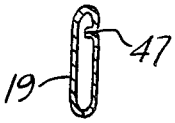
FIG. 5
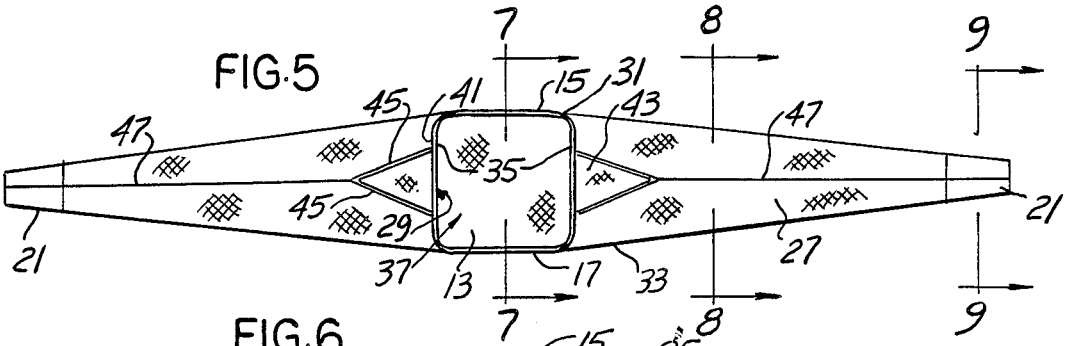
FIG. 6
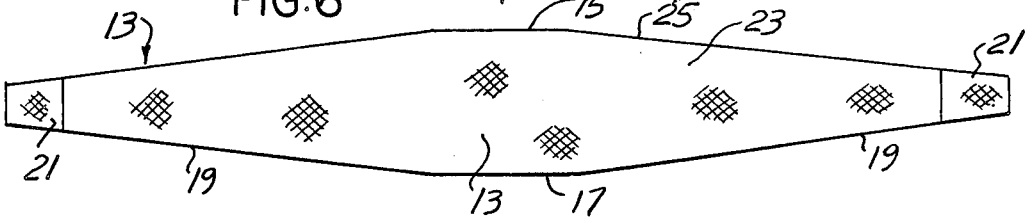

UNISEX TORSO GARMENT WITH SLEEVES

BACKGROUND OF THE INVENTION

The present invention is directed to garments for use by both males and females and is more particularly directed to a garment which covers the upper torso of the user either at the front or back thereof.

Heretofore various torso type of garments have been employed covering portions of the torso and including sleeves and normally employing front and back panels. One difficulty with garments of this type is that normally different garments are needed for males and females.

Another difficulty is that current garments of this type have front and back panels. There is a need for a torso garment with a single panel selectively positionable over the front of a female user and over the back of a male user.

SUMMARY OF THE INVENTION

An important feature of the present invention is to provide a unitary garment which selectively covers the front or back upper torso, such that the panel may cover the front of a female or the back upper torso of a male. The garment includes a single upper torso covering panel and a pair of sleeves, preferably tapered, projecting therefrom. Rear portions of the sleeves are spaced apart and open at their inner ends. Top and bottom boundaries of the sleeves at their inner ends merge respectively with the top and bottom of the front panel such that the overall construction is tubular.

The present torso garment is constructed as a unit garment, preferably of a stretch or resilient cloth material, wherein the torso panel terminates in a pair of tapered sleeves, which at their inner ends are open rearwardly of the front panel. The sleeve edges are medially stitched together along their length. A pair of triangular gussets are interposed within rear upper portions of the sleeves with the bases of the gussets in registry with the inner edges of the sleeves. Converging portions of the gussets are stitched to adjacent portions of the sleeve, with such stitching merging with the medial stitching along the length of the sleeve.

These and other features will be seen from the following specification and claims in conjunction with the appended drawing:

THE DRAWING

FIG. 1 is a front elevational view of the present torso garment with the front panel facing forwardly, as worn.

FIG. 2 is a rear elevational view thereof illustrating the opening between the inner ends of the sleeves.

FIG. 3 is a front elevational view of the torso garment as worn by a male.

FIG. 4 is a rear elevational view thereof.

FIG. 5 is a front elevational view of the torso garment in FIG. 3 before forming the assembly upon a user.

FIG. 6 is a rear elevational view thereof, corresponding to FIG. 1.

FIG. 7 is a section taken in the direction of arrows 7—7 of FIG. 5.

FIG. 8 is a section taken in the direction of arrows 8—8 of FIG. 5.

FIG. 9 is a section taken in the direction of arrows 9—9 of FIG. 5.

It will be understood that the above drawing illustrates merely a preferred embodiment of the invention and that other embodiments are contemplated within the scope of the claims hereafter set forth.

DETAILED DESCRIPTION OF AN EMBODIMENT OF THE INVENTION

The embodiment of the present torso garment or wearing apparel is generally indicated at 11, FIG. 1, sometimes referred to as "sleeves", is constructed of a soft, preferably stretch fabric material, such as a jersey, and is of a unitary construction. The torso garment adapted for covering the upper portion of a human torso has a front panel 13 having substantially parallel top and bottom edges 15 and 17, FIG. 6, and a pair of outwardly directed tapered sleeves 19 with resilient cuffs 21. As used herein, "front" and "back" are relative terms, particularly in view of the fact that the garment is reversible.

The inner ends of the sleeves 19 are of a maximum height corresponding substantially to the height of the front panel 13 and extend from and merge with opposite sides of the front panel as a continuation thereof. The front portions 23 of each sleeve at its inner end at 25 and at its top and bottom boundaries merge with the adjacent ends of the corresponding top and bottom ends 15 and 17 of the front panel.

FIG. 5 is a rear view of the torso garment shown in FIG. 2, wherein the inner ends of the sleeves 19 are open as at 29. The upper boundary 31 and the lower boundary 33 of said sleeves at their inner ends smoothly merge with top and bottom edges 15 and 17 of front panel 13.

The spaced apart open inner ends 29 of the respective sleeves as viewed from the rear of the garment, FIG. 2, define a central opening 37 which includes a pair of upright spaced apart side edges 35.

The lower ends of the respective side edges 35 extend downwardly and curved inwardly and merge with the bottom edge 17 of front panel 13. The corresponding upper ends of the side edges 35 are curved inwardly and merge with end portions of the upper edge 15 of the front panel.

The central opening 37 rearwardly of said front panel is substantially coextensive therewith and provides access for the user's arms into the sleeves and for cooperative engagement with portions of the user'neck.

The material of garment adjacent the opening 37 is folded over around its periphery 37 and is secured by the continuous peripheral stitching 41, FIG. 2.

Upon the rear upper portions 27 of the corresponding sleeve 19 are a pair of opposed outwardly directed triangular gussets 43, FIG. 5, with their inner base edges corresponding to the side edges 35 of the opening 37. These merge with the folded over edge 35 around the opening 37 and have corresponding stitching 41 therethrough.

Gussets 43 each have edges which converge inwardly. These edges are in registry with the inner edges of rear portions 27 of the sleeves and are connected thereto by the continuous stitching 45. At the apex of said gussets, said stitching merges with medial stitching 47 at the meeting edges of the corresponding sleeves, out to the outer ends thereof including the cuffs 21.

The stitches 45 and 47 are completed upon the inner side of garment at manufacture, so that when reversed, all that shows are the lines 45 and 47 corresponding to said stitching.

One use of the garment of this invention, when worn by a female, the user merely faces the garment shown in FIG. 5 and places her respective arms into the sleeves 19 so that the front panel 13 covers the upper portion of the user's torso wth the sleeves extending over the shoulders, leaving the back open all the way down to the lower edge 17 of said front panel. Alternatively, the user may wear the garment over another garment, such as a swimsuit to protect the shoulders, wherein the "front" panel may be worn over the back. For use alone by females, for example, the assembly of the torso garment is such that the panel 13 overlies the front of the user with upper portions thereof along the top edge engaging a portion of the user's neck, FIG. 1.

The present torso garment is made of a soft fabric material, is of unitary tubular construction and can be used by either sex. An attractive emblem or slogan can be silk screened or otherwise impressed upon the panel 13, as is considered common practice today. The tubular garment may also be conveniently worn around the neck as a scarf.

Except for the triangular gussets 43, the present torso garment is made from a single strip or tube of material which is properly cut and formed so that with the application of the triangular gussets 43, meeting edges of the rear portions of the sleeves, are brought together and joined to the gussets by stitching 45 and are suitably connected thereto. The additional meeting edges of the sleeves are secured together by medial stitching 47 which extends outwardly to the outer edge of resilient cuffs 21.

The sleeves 23 can also be forshortened, omitting the cuffs 21 so that the sleeves of the garment extend approximately to the elbows of the user in a "three quarter" length or "short" sleeves may be provided. Thus the present garment is adapted for selectively covering the front or back upper torso of a wearer.

Having described my invention, reference should now be had to the following claims:

I claim:

1. A unitary tubular garment for selectively covering the front or back upper torso and arms of the wearer, said garment comprising a torso engaging panel of a fabric material;

a pair of opposed sleeves continuous with said panel and, at their inner ends, being of maximum circumference extending from and merging with opposite sides of front panel as a continuation thereof, and tapering laterally outward;

the portions of the sleeves adjacent said panel being open at their inner ends defining a central opening and at their upper and lower boundaries merging respectively with the top and bottom of said panel the portions of said sleeves adjacent said central opening each including an outwardly converging triangular gusset having a base in alignment with the edges defining said central opening and stitching interconnecting the converging edges of each gusset with the adjacent edge portions of each of said sleeves.

2. In the garment of claim 1, said front panel before use having parallel top and bottom edges, said upper and lower boundaries merging with said top and bottom edges, respectively.

3. In the garment of claim 1, said portions of said sleeves at their inner ends before use terminating in substantially upright spaced apart edges connected to and merging with the top and bottom edges of said panel at the rear thereof.

4. In the garment of claim 3, said upright edges and top and bottom edges defining an opening in registry with and spaced rearwardly of said panel.

5. In the garment of claim 4, peripheral edge portions of the material defining said opening being folded over;

and continuous peripheral stitching securing said edge portions to the material around said opening.

6. A continuous reversible tubular unitary garment having tubular sleeve portions and a central portion continuous with said sleeve portions including a central opening between said sleeve portions for receiving the shoulders of the wearer, gussets having an apex sewn into said tubular sleeve portions and a base portion defining an edge of said central opening, enlarging said central portion and defining a panel covering the front or back of the wearer.

* * * * *